US006827422B2

(12) United States Patent
Horie

(10) Patent No.: US 6,827,422 B2
(45) Date of Patent: Dec. 7, 2004

(54) LIQUID SUCTION APPARATUS FOR LIQUID EJECTING HEAD AND LIQUID EJECTING APPARATUS

(75) Inventor: Kazuki Horie, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/392,326

(22) Filed: Mar. 20, 2003

(65) Prior Publication Data

US 2004/0080586 A1 Apr. 29, 2004

(30) Foreign Application Priority Data

Mar. 20, 2002 (JP) ..... 2002-079758
Mar. 18, 2003 (JP) ..... 2003-073947

(51) Int. Cl.[7] ..... B41J 2/165
(52) U.S. Cl. ..... 347/29; 347/30
(58) Field of Search ..... 347/22–35

(56) References Cited

FOREIGN PATENT DOCUMENTS

JP 5-246045 9/1993
JP 06-270417 9/1994
JP 07-214794 A 8/1995
JP 2001-096758 A 4/2001

*Primary Examiner*—Shih-Wen Hsieh
(74) *Attorney, Agent, or Firm*—Sughrue Mion, PLLC

(57) ABSTRACT

The apparatus has a cap member to internally form a closed space when it makes contact with a nozzle forming face of a liquid ejecting head, a negative pressure generating unit for ejecting a fluid in the closed space and generating negative pressure in the same, and a filter member arranged so that at least a part thereof is positioned in the cap member. On the downstream side of the filter member in the liquid flow direction during suction, a common negative pressure chamber to apply almost uniform negative pressure on almost overall the filter member is formed. The negative pressure generating unit ejects fluid in the common negative pressure chamber. The filter function of the filter member installed on the cap member can be used sufficiently overall the filter member.

15 Claims, 10 Drawing Sheets

LIQUID SUCTION APPARATUS FOR LIQUID EJECTING HEAD AND LIQUID EJECTING APPARATUS

BACKGROUND OF THE INVENTION

1. Field of the Invention

The present invention relates to a liquid suction apparatus for sucking a liquid from a plurality of nozzle openings of a liquid ejecting head and a liquid ejecting apparatus having this liquid suction apparatus.

2. Description of the Related Art

As a typical example of a conventional liquid ejecting apparatus, there is an ink jet printer having an ink jet printing head for image recording. As other liquid ejecting apparatuses, for example, an apparatus having a color material jet head used for manufacturing a color filter of a liquid crystal display, an apparatus having an electrode material (conductive paste) jet head used for forming electrodes of an organic EL display or an FED (Face Emission Display), an apparatus having a biological organic substance jet head used for manufacturing biological chips, and an apparatus having a sample jet head as a precise pipette may be cited.

An ink jet printer as a typical example of a liquid jet recorder makes comparatively small noise during printing and moreover can form small dots in high density, so that it has been used recently in various types of printing including color printing.

Such an ink jet printer generally has a printing head (liquid ejecting head) which is loaded on a carriage and moves back and forth in the width direction (head scanning direction) of a recording medium such as recording paper and a feed means for moving the recording medium in the direction (medium feed direction) perpendicular to the head scanning direction.

In the ink jet printer, printing is executed by ejecting ink drops (liquid drops) from the printing head to the recording medium in correspondence with print data. And, the printing head loaded on the carriage is structured so as to eject various colors of ink, for example, black, yellow, cyan, and magenta, thus not only text printing by black ink but also full color printing can be executed by changing the ejection rate of each ink.

Since the aforementioned printing head prints by ejecting ink pressurized in a pressure chamber as ink drops from the nozzle opening toward the recording medium, a problem arises that for example, by increasing of the ink viscosity caused by evaporation of a solvent from the nozzle opening, setting of ink, attachment of dust, moreover inclusion of air bubbles, defective printing is caused.

Therefore, when the nozzle opening of the printing head is clogged or when an ink cartridge is exchanged, the nozzle opening forming face of the printing head is sealed by the cap member, and ink is sucked and ejected from the nozzle opening by negative pressure from a suction pump (tube pump), thus a liquid suction apparatus for executing a cleaning operation for preventing defective ink ejection due to clogging by ink setting in the nozzle opening or inclusion of air bubbles into the ink feed path is generally included in the ink jet printer.

A conventional liquid suction apparatus, for example, described in Japanese Patent Laid-Open Publication No. 2001-096758, has a suction pump and a cap member connected to the suction pump for sealing a nozzle forming face of a printing head. And, in the conventional liquid suction apparatus, in a state that the nozzle forming face is sealed by the cap member, a liquid (air, ink) is ejected from the inside of the cap member by the suction pump. By doing this, due to a negative pressure generated inside the cap member, ink in the printing head and on the upstream side thereof is sucked and the printing head is internally cleaned.

By this cleaning operation (ink suction operation), filling the printing head with ink, suction and ejection of deteriorated ink from the printing head, and ejection of air bubbles generated in the ink in the printing head are carried out, and the ink filling state in the printing head is kept normal, and good printing is made possible.

Further, the suction pump is operated by an instruction from the controller in the printer or the host computer, thus the negative pressure generation time and negative pressure generation amount can be controlled.

FIG. 18 shows a state that the nozzle forming face of the printing head of the conventional ink jet printer is sealed by the cap member and a cap member 60 is in contact with a nozzle forming face 23 of a printing head 9 in which a plurality of nozzle openings 22 are formed. Inside the cap member 60, a filter member 62 is arranged in close contact with the bottom of the cap member 60. A liquid (air, ink) in the cap member 60 is sucked and ejected by a pump 61.

In the conventional ink jet printer shown in FIG. 18, not only in a case of execution of cleaning but also in a case that the ink jet printer is in a non-printing state, the nozzle forming face 23 of the printing head 9 is sealed by the cap member 60. The filter member 62 installed in the cap member 60 is in a wet state due to ink ejected from the printing head 9 at the time of cleaning or flashing. Therefore, when the nozzle forming face 23 of the printing head 9 is sealed by the cap member 60, the humidity in the cap member 60 is increased, and the moisture retention effect in the neighborhood of the nozzle openings 22 is increased, thus the setting of ink in the nozzle openings 22 can be suppressed.

In the conventional liquid suction apparatus aforementioned, as shown in FIG. 18, the filter member 62 is arranged in close contact with the inner bottom of the cap member 60. Therefore, in the entire filter member 62, in the neighborhood of an ejection port 63 formed in the bottom of the cap member 60, comparatively high suction force is reserved for a liquid (air, ink), while in the area away from the ejection port 63, no sufficient suction force can be obtained. Namely, the suction force for ink flowing down on the top of the filter member 62 differs depending on the position in the entire filter member 62 and ink concentratedly passes through the part in the neighborhood of the ejection port 63. In this case, the filter function of the entire filter member 62 cannot be used effectively, and the filter member 62 is locally deteriorated rapidly in the neighborhood of the ejection port 63 as well, thus a problem arises that the life span of the filter member 62 is shortened.

Furthermore, in the conventional liquid suction apparatus, after ending of filling of ink after exchanging the ink cartridge or even after the nozzle opening is recovered from clogging, as long as the negative pressure generating unit is operated, the ink suction flow rate is not suppressed and ink is continuously sucked from the nozzle opening.

In cleaning of a printing head having a plurality of nozzle openings, particularly a plurality of nozzle openings for different ink kinds, due to the structure of ink flow path or the composition factor of ink, the negative pressure and ink suction rate necessary for cleaning may be different for each nozzle opening or nozzle opening group. Therefore, in the conventional liquid suction apparatus, there is a problem imposed that depending on the difference in the required time for recovery of clogging or filling of ink for each nozzle opening or each nozzle opening group, an amount of ink larger than necessary is sucked for the easily recoverable nozzle opening or nozzle opening group and although there is a non-recovered or non-filled nozzle, the suction operation is ended at the point of time when the total suction amount reaches a set value. Further, there is another problem imposed that due to ink suction from a nozzle opening recovered from clogging, the negative pressure in the cap member is reduced, thus the effective transfer of negative pressure to a nozzle opening which is not recovered from clogging yet is prevented.

Further, the operation of the negative pressure generating unit is controlled on the basis of information such as the continuous non-printing time of the printer. However, the ink clogging state is affected by various factors including the temperature and humidity history, so that it is difficult to adjust the operation of the negative pressure generating unit in accordance with such an actual condition and suck ink in proper quantities in correspondence to various ink clogging states of the printing head. Therefore, a case that an unnecessarily large amount of ink is sucked during the cleaning operation and the ink consumption efficiency is adversely affected is caused.

SUMMARY OF THE INVENTION

The present invention has been developed with the foregoing in view and is intended to provide a liquid suction apparatus for a liquid ejecting head capable of sufficiently using a filter function of a filter member installed in a cap member overall the filter member body and a liquid ejecting apparatus having the liquid suction apparatus.

Further, the present invention is intended to provide, even when liquid suction conditions necessary for recovery of clogging or filling of ink are different for each nozzle opening or nozzle opening group, a liquid suction apparatus for a liquid ejecting head capable of suppressing excessive liquid suction from a nozzle opening or a nozzle opening group of easy recovery of clogging or easy filling of ink and efficiently applying negative pressure to a non-recovered or non-filled nozzle opening or nozzle opening group and a liquid ejecting apparatus having the liquid suction apparatus.

Further, the present invention is intended to provide a liquid suction apparatus for a liquid ejecting head capable of suppressing suction of an unnecessarily large amount of liquid during the liquid suction operation and a liquid ejecting apparatus having the liquid suction apparatus.

To solve the aforementioned problems, the present invention is a liquid suction apparatus for sucking a liquid from a plurality of nozzle openings of a liquid ejecting head for ejecting liquid drops toward an object from said plurality of nozzle openings, comprises: a cap member configured to internally form a closed space when said cap member makes contact with a nozzle forming face of said liquid ejecting head; a negative pressure generating unit configured to eject a fluid in said closed space formed in said cap member and generate negative pressure in said closed space; and a filter member arranged so that at least a part thereof is positioned in said cap member, wherein a common negative pressure chamber is formed on a downstream side of said filter member in a liquid flow direction during suction, said common negative pressure chamber being configured to apply an almost uniform negative pressure on almost overall said filter member, said negative pressure generating unit being connected to said cap member so as to eject a fluid in said common negative pressure chamber.

Preferably, said filter member is structured so that when said cap member makes contact with said nozzle forming face, a liquid receiving space is formed between said nozzle forming face and said filter member.

Preferably, said liquid receiving space is a single space corresponding to all of said plurality of nozzle openings.

Preferably, said liquid receiving space is divided into a plurality of individual spaces.

Preferably, said plurality of nozzle openings constitute several nozzle rows, said plurality of individual spaces being formed in correspondence with respective several nozzle rows.

Preferably, said filter member is structured so as to effectively function only in narrow areas extending along positions opposite to said respective several nozzle rows.

Preferably, said plurality of individual spaces are formed for each nozzle opening group composed of a plurality of nozzle openings of a common liquid kind to be ejected.

Preferably, said plurality of individual spaces are formed by partition members provided separately from said filter member.

Preferably, said plurality of individual spaces are formed by said filter member itself.

Preferably, said filter member is structured so as to make close contact with at least a part of said nozzle forming face when said cap member makes contact with said nozzle forming face.

Preferably, said filter member is structured so as to make close contact with almost overall said nozzle forming face when said cap member makes contact with said nozzle forming face.

Preferably, said filter member is structured so that a part thereof is projected from said cap member toward said nozzle forming face.

Preferably, said common negative pressure chamber is filled with a fluid permeable filler material, said fluid permeable filler material having a fluid resistance such that substantially uniform pressure is generated in overall said common negative pressure chamber when a gas passes through said common negative pressure chamber.

Preferably, said filler material is an expanding agent.

To solve the aforementioned problems, the present invention is a liquid suction apparatus for sucking a liquid from a plurality of nozzle openings of a liquid ejecting head for ejecting liquid drops toward an object from said plurality of nozzle openings, comprises: a cap member configured to internally form a closed space when said cap member makes contact with a nozzle forming face of said liquid ejecting head; a negative pressure generating unit configured to eject a fluid in said closed space formed in said cap member and generate negative pressure in said closed space, said negative pressure generating unit including a suction pump and a suction pipe connecting said suction pump to said cap member; and a flow rate control unit installed in a middle of said suction pipe, said flow rate control unit being configured to control a flow rate of liquid by a liquid flow resistance.

To solve the aforementioned problems, the present invention is a liquid ejecting apparatus comprises: a liquid ejecting head configured to change pressure of a liquid in pressure chambers respectively interconnecting to a plurality of nozzle openings and eject liquid drops toward an object from said nozzle openings; and any one of aforementioned liquid suction apparatuses.

According to the present invention having the aforementioned constitution, the common negative pressure chamber configured to apply almost uniform negative pressure on almost entire rear of the filter member is installed, so that the filter function of the filter member installed on the cap member can be used sufficiently overall the filter member.

Further, according to the present invention, even when liquid suction conditions necessary for recovery of clogging or filling of a liquid are different for each nozzle opening or a nozzle opening group, excessive liquid suction from a nozzle opening or a nozzle opening group of easy recovery of clogging or easy filling of a liquid can be suppressed and negative pressure can be effectively applied on a non-recovered or non-filled nozzle opening or nozzle opening group.

Further, according to the present invention, when the liquid suction operation for sucking a liquid from a plurality of nozzle openings of the liquid ejecting head is to be performed, suction of an unnecessarily large amount of liquid can be suppressed.

BRIEF DESCRIPTION OF THE DRAWINGS

The aforementioned and other objects, characteristics, and advantages of the present invention will become more apparent from the following descriptions with reference to the accompanying drawings, wherein.

DESCRIPTION OF THE PREFERRED EMBODIMENTS

The ink jet printer as an embodiment of the liquid ejecting apparatus of the present invention will be explained hereunder with reference to FIGS. 1 to 10.

Figure 1:
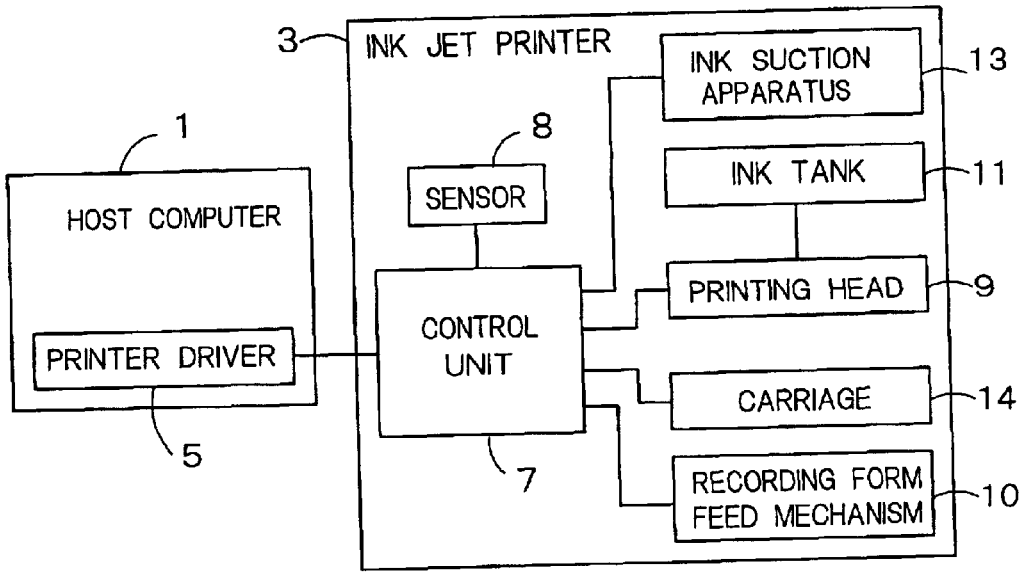
FIG. 1 is a block diagram showing the system configuration of an ink jet printer as an embodiment of the liquid ejecting apparatus of the present invention.

As shown in FIG. 1, an ink jet printer 3 of this embodiment is connected to a host computer 1 via a local printer cable or a communication network. In the host computer 1, a printer driver 5, which is software for sending a command for executing printing or cleaning to the ink jet printer 3, is loaded.

The ink jet printer 3 includes a control unit 7 for controlling the units indicated below on the basis of a command from the printer driver 5 and information from a sensor 8 in the printer 3, a printing head 9 having a plurality of nozzle openings, ink tanks 11 loaded on the printing head 9 or separately installed, an ink suction apparatus 13 for sucking ink from the plurality of nozzle openings of the printing head 9, a carriage 14 for loading and moving the printing head 9, and a recording form feeding mechanism 10 for sending recording forms.

Figure 2:
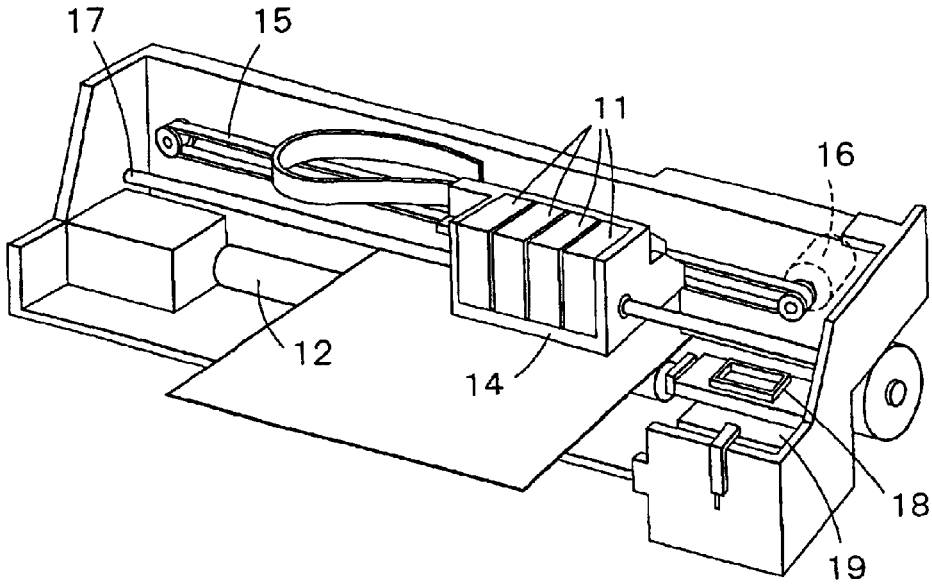
FIG. 2 is a perspective view showing an ink jet printer as an embodiment of the liquid ejecting apparatus of the present invention.

As shown in FIG. 2, in the ink jet printer of this embodiment, on the upper part of the carriage 14, the ink tanks 11 are mounted in a removable state. To the lower part of the carriage 14, the printing head 9 is fixedly mounted. The carriage 14 is connected to a motor 16 via a belt 15 and moves back and forth along a guide rail 17 in the axial direction of a platen 12.

In the home position at the end of the moving path of the carriage 14, a capping system 18 for covering and closing the nozzle forming face of the printing head is arranged. The capping system 18 has a function for preventing the nozzle opening part of the printing head 9 from drying of ink and a function for applying negative pressure from a suction pump 19, which is a negative pressure generating unit, on the nozzle openings and forcibly sucking and ejecting ink from the nozzle openings. The capping system 18 and the suction pump 19 constitute the ink suction apparatus 13.

Figure 3:
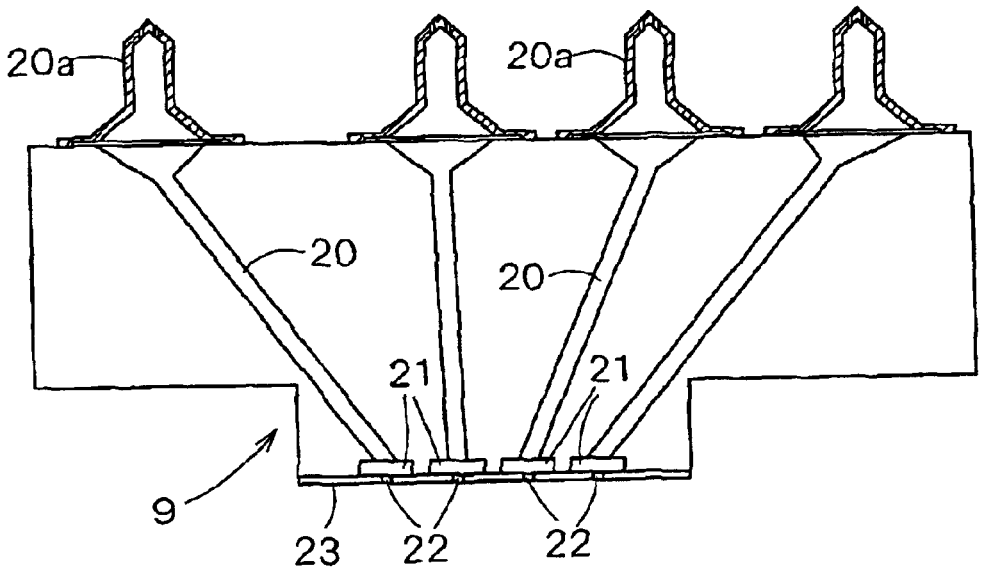
FIG. 3 is a sectional view showing the printing head of the ink jet printer shown in FIGS. 1 and 2 which is enlarged.

FIG. 3 is a sectional view of the printing head 9 of the ink jet printer of this embodiment. Particularly, the printing head 9 used for a color printer ejects a plurality of kinds of ink, so that it has independent ink paths 20 for each ink kind. Here, different ink means that not only the apparent color difference but also the kind or ratio of components is different. And, ink from the ink tanks 11 flows into the ink paths 20 via ink feed needles 20*a*. The paths 20 independent for each ink kind are respectively interconnected to a plurality of pressure chambers 21. To each pressure chamber 21, each nozzle opening 22 is interconnected, and during printing, ink drops pushed out from the pressure chambers 21 are ejected from the nozzle openings 22.

Figure 4:
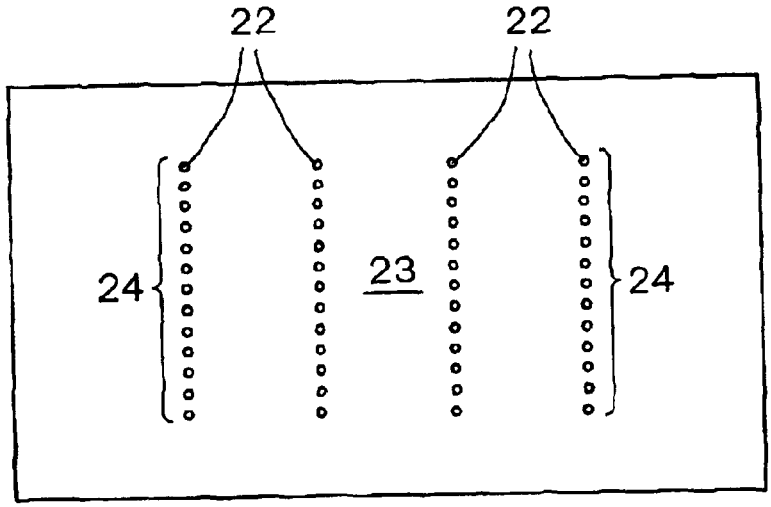
FIG. 4 is a plan view showing the nozzle forming face of the printing head shown in FIG. 3.

FIG. 4 is a front view of a nozzle forming face 23 of the printing head 9. In the nozzle forming face 23, a plurality of nozzle openings 22 for ejecting ink are formed. The plurality of nozzle openings 22 constitute several nozzle opening groups (nozzle rows) 24 corresponding to the ink kinds, and generally, one nozzle opening group 24 is composed of several tens to several thousands nozzle openings 22.

Figure 5:
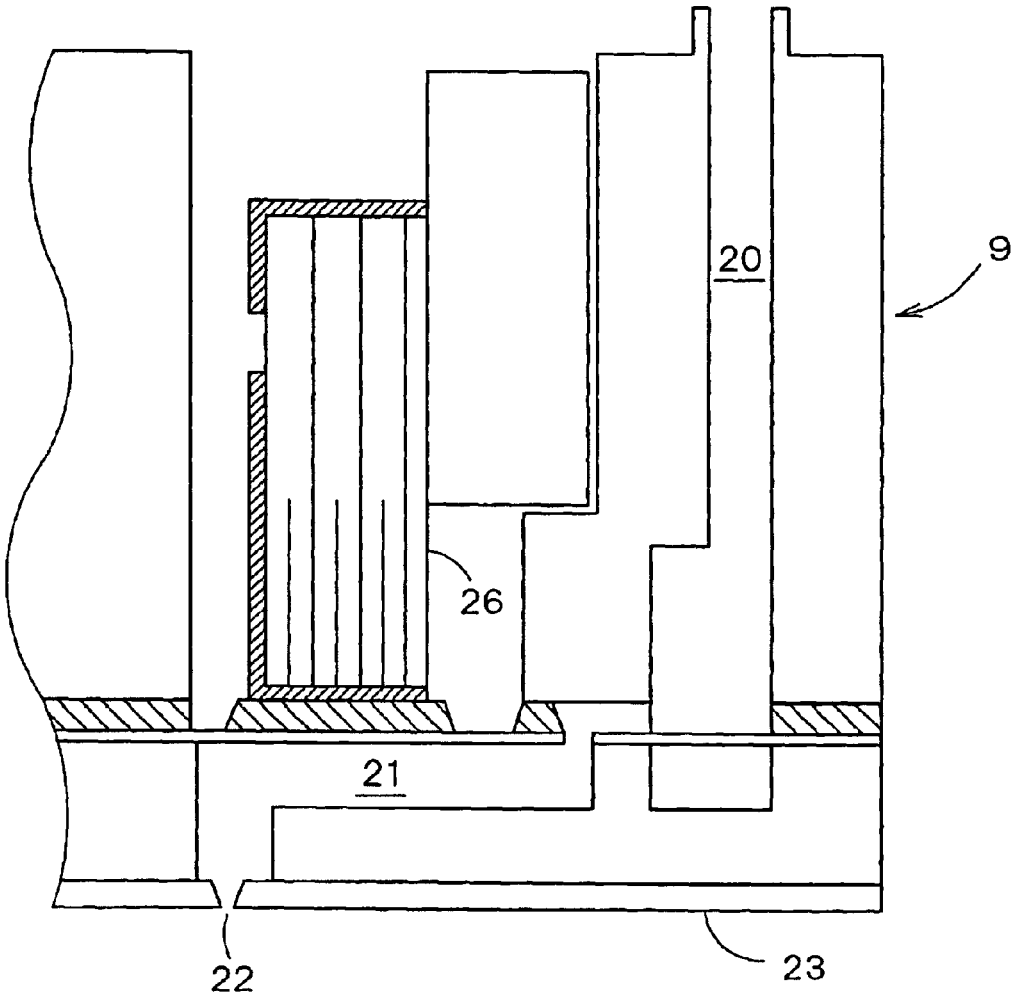
FIG. 5 is a sectional view showing the internal structure of the printing head shown in FIG. 3.

FIG. 5 is a sectional view showing the internal structure of the printing head 9 of the ink jet printer of this embodiment. Ink fed from the ink tanks 11 is fed to the pressure chambers 21 via the ink paths 20. And, during printing, by the expansion and contraction operation of a piezo-vibrator 26 which is a pressure generation element, the volume of the pressure chamber 21 is changed, and the ink pressure in the pressure chamber 21 is changed, thus ink drops are ejected from the nozzle opening 22.

On the other hand, when air bubbles get mixed in ink in the printing head 9 or there exists increased viscosity ink in the ink flow path, normal flow of ink is obstructed and ink may not be ejected normally. Therefore, in such a case, ink must be forcibly ejected by the ink suction apparatus 13.

Further, at the start time of first use of the ink jet printer or when an ink tank is exchanged with an ink tank of another kind of ink, the ink flow path in the printing head 9 must be filled with ink. Also at the time of initial filling like this, by the ink suction apparatus 13, air and ink are forcibly sucked and ejected from the nozzle openings 22 of the printing head 9.

Figure 6:
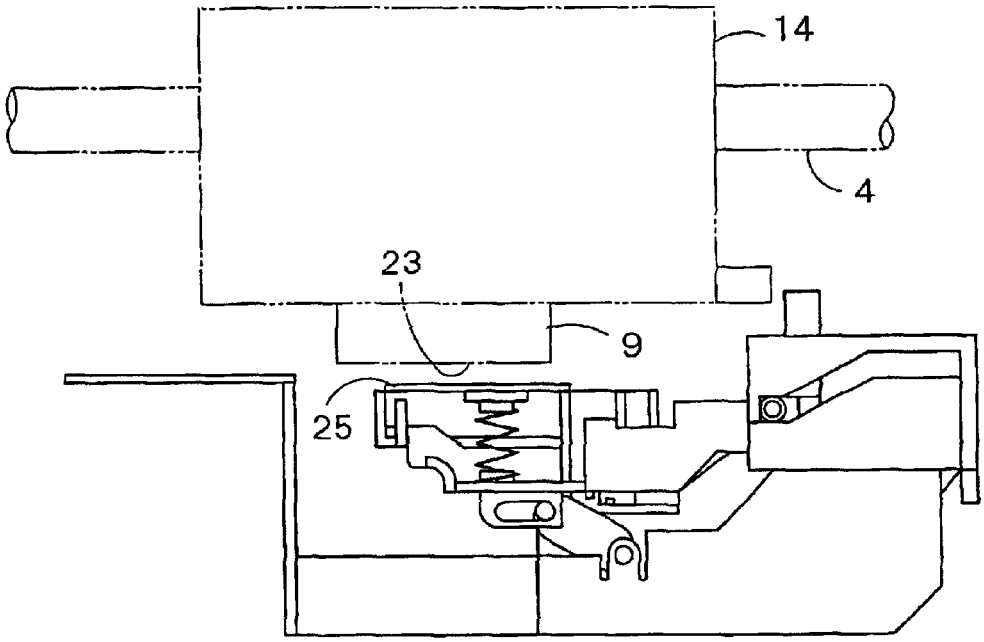
FIG. 6 is a front view showing the non-capping state of the capping system of the ink suction apparatus of the ink jet printer shown in FIGS. 1 and 2.
Figure 7:
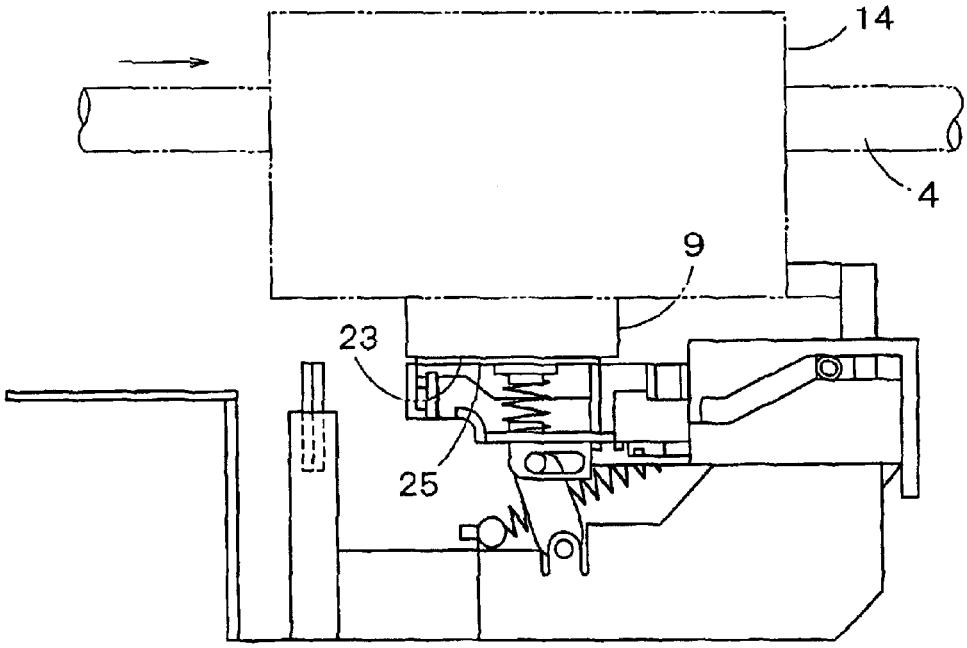
FIG. 7 is a front view showing the capping state of the capping system shown in FIG. 6.

FIG. 6 shows the capping system of the ink suction apparatus 13 of the ink jet printer of this embodiment. The printing head 9 and the carriage 14, during printing, are away from the capping system. On the other hand, at the time of cleaning, the carriage 14 and the printing head 9 move to the home position and as shown in FIG. 7, the nozzle forming face 23 of the printing head 9 is sealed by the cap member 25 of the capping system. In this state, the negative pressure from the suction pump 19 can be applied to the printing head 9.

Figure 8:
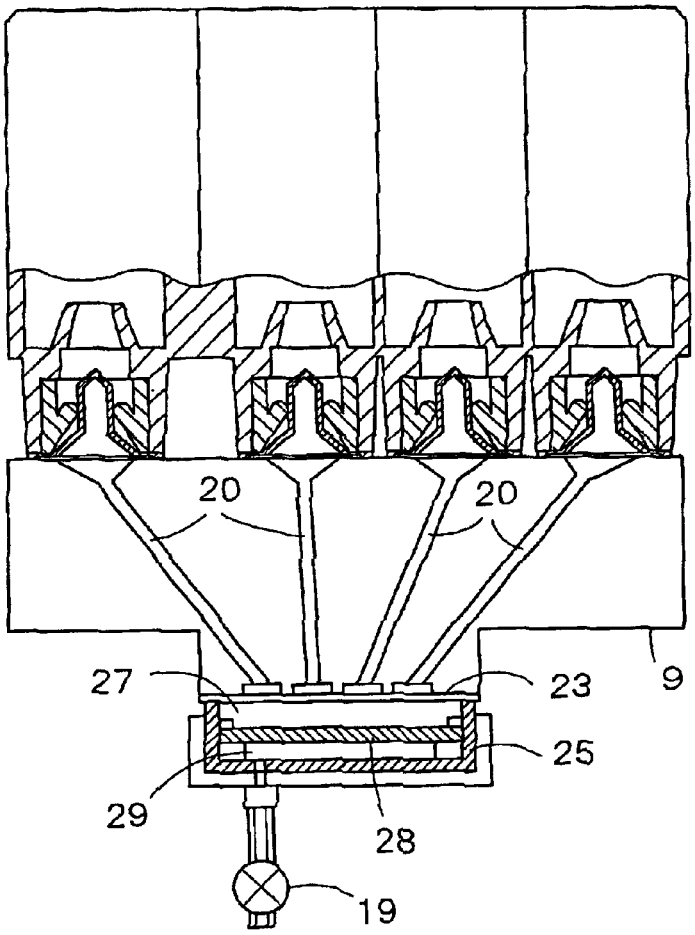
FIG. 8 is a sectional view showing the state that the printing head of the ink jet printer shown in FIGS. 1 and 2 is capped by the capping system.
Figure 9:
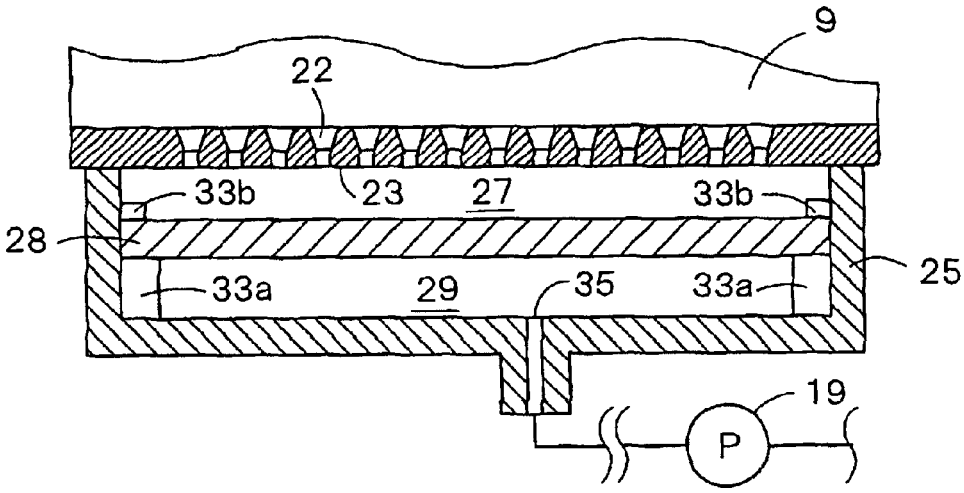
FIG. 9 is a sectional view showing the cap member shown in FIG. 8 and its neighborhood which are enlarged.

FIG. 8 shows the state that the printing head 9 of the ink jet printer of this embodiment is capped by the cap member 25 of the capping system. Further, FIG. 9 shows the cap member 25 and its neighborhood which are enlarged.

The cap member 25 is structured, when the printing head 9 moves to the home position, so as to seal the nozzle forming face 23 of the printing head 9 and form a closed space in the cap member 25. By doing this, in the printing stop state, the nozzle openings 22 can be prevented from drying of ink.

Furthermore, the cap member 25 has an outlet 35 to be connected to the suction pump 19. The suction pump 19 ejects a fluid (air, liquid) in the closed space formed in the cap member 25 and generates negative pressure in the closed space. By doing this, the inside of the cap member 25, during cleaning of the printing head 9, becomes a part of the path for transferring the negative pressure generated in the suction pump 19 to the ink flow path 20 in the printing head 9.

Further, in the cap member 25, a filter member 28 extending in parallel with the nozzle forming face 23 of the printing head 9 is installed. The flat filter member 28 is loaded on the top of steps 33*a* installed in the cap member 25 and fixed by fittings 33*b*.

The filter member 28 lets gas such as air pass through, thereby enables quick transfer of negative pressure. However, at the time of passing of a liquid such as ink, a high flow resistance is generated in the filter member 28 and ink suction is suppressed against an increase in the negative pressure due to the continuous operation of the suction pump 19.

As shown in FIG. 9, on the downstream side of the filter member 28 in the liquid flow direction during suction, that is, on the rear side of the filter member 28 viewed from the side of the nozzle forming face 23, a common negative pressure chamber 29 for applying almost uniform negative pressure on almost overall the rear of the filter member 28 is formed because the filter member 28 is operated as a partition. The outlet 35 is interconnected to the common negative pressure chamber 29 and a fluid in the common negative pressure chamber 29 is ejected by the suction pump 19.

Further, the filter member 28 is arranged halfway in the depth direction in the cap member 25. Therefore, when the cap member 25 makes contact with the nozzle forming face 23, an ink receiving space 27 is formed between the nozzle forming face 23 and the filter member 28. The ink receiving space 27 is a single space corresponding to all of the plurality of nozzle openings 22.

Next, the operation and action for sucking and ejecting ink from the plurality of nozzle openings 22 of the printing head 9 by the ink suction apparatus 13 will be explained.

At the point of time when the cleaning operation (ink suction operation) is started, no ink exists in the ink receiving space 27 and the common negative pressure chamber 29 in the cap member 25 and air is filled. Further, no ink exists in the flow path connecting the cap member 25 and the suction pump 19 and air is filled.

And, as shown in FIG. 9, when the suction pump 19 is operated in the state that the nozzle forming face 23 of the printing head 9 is sealed by the cap member 25, air in the common negative pressure chamber 29 is sucked toward the suction pump 19 via the outlet 35. By doing this, the common negative pressure chamber 29 enters into the negative pressure state and the negative pressure is applied on the filter member 28. At this time, the pressure in the common negative pressure chamber 29 becomes almost uniform entirely in the common negative pressure chamber 29, so that the negative pressure applying on the filter member 28 becomes almost uniform overall the rear of the filter member 28.

As mentioned above, in this embodiment, the common negative pressure chamber 29 is provided, thus the negative pressure can be applied almost uniformly on overall the filter member 28, so that the filter function of the filter member 28 can be sufficiently used overall the filter member 28.

The negative pressure is applied on the filter member 28, thus air in the ink receiving space 27 is pulled in the common negative pressure chamber 29 via the filter member 28 and moreover sucked by the suction pump 19. In correspondence with it, ink in the printing head 9 and the ink tanks 11 is sucked via the nozzle openings 22 and ejected into the ink receiving space 27.

At the first stage of the ink suction operation, a fluid passing through the filter member 28 is mostly gas such as air, so that the fluid immediately passes through the filter member 28.

Figure 10:
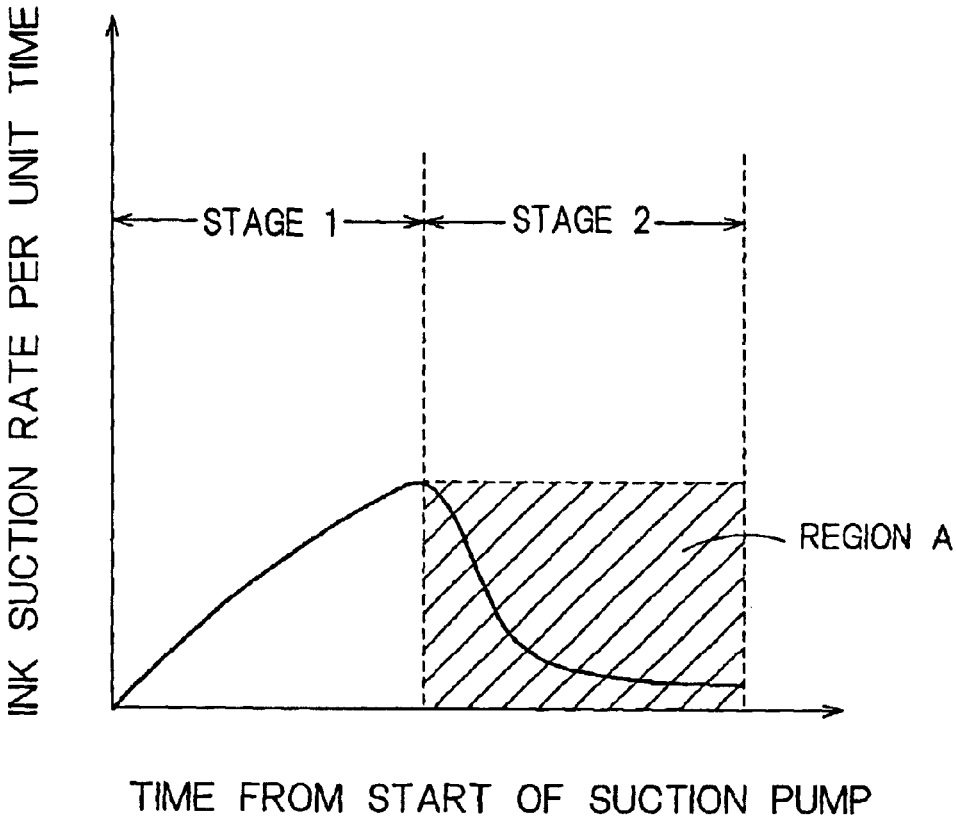
FIG. 10 is a drawing showing the change with time of the ink suction rate per unit time when ink is sucked by the ink suction apparatus of the ink jet printer shown in FIGS. 1 and 2.

FIG. 10 shows the ink suction rate (ink flow rate) per unit time from the start time of the operation of the suction pump 19 (the time of negative pressure generation). In FIG. 10, as shown at Stage 1, at the initial stage of the ink suction operation, the ink suction rate per unit time increases as the operation time of the suction pump 19 elapses and ink suction is not suppressed.

Furthermore, when the ink suction operation is continued, following gas, ink in the printing head 9 and the ink tanks 11 tends to pass through the filter member 28. At this time, the filter member 28 generates a flow resistance for the ink flow, so that the ink flow rate is suppressed. Therefore, as shown at Stage 2 in FIG. 10, although the suction pump 29 operates continuously, the ink suction rate per unit time is reduced and changed within the region A shown in FIG. 10.

As mentioned above, in this embodiment, the common negative pressure chamber 29 for applying uniform negative pressure on the entire rear of the filter member 28 is installed, so that the filter function of the filter member 28 can be sufficiently used overall the same.

Further, in this embodiment, at the initial stage after start of ink suction, a sufficient suction rate can be reserved and at a stage that the ink suction operation proceeds to a certain degree, the suction rate can be slowly suppressed automatically without changing the operation condition of the suction pump 19. Therefore, at the time of the ink suction operation, ink suction more than necessary can be suppressed.

Next, the ink jet printer of another embodiment of the present invention will be explained by referring to FIGS. 11 and 12. Further, the explanation of the parts common to the aforementioned embodiment is omitted and different parts will be explained.

Figure 11:
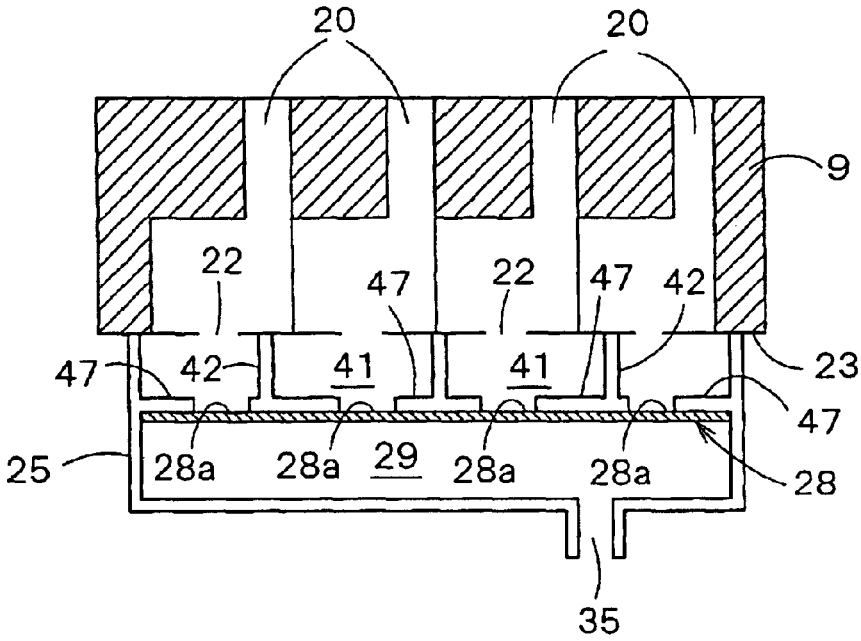
FIG. 11 is a sectional view showing the printing head and cap member in the capping state in an ink jet printer as another embodiment of the liquid ejecting apparatus of the present invention.
Figure 12:
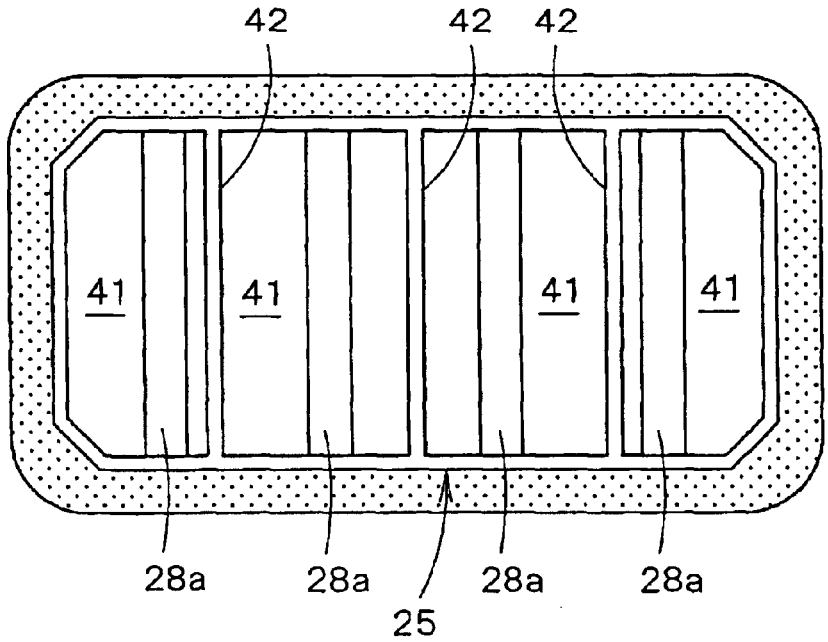
FIG. 12 is a plan view showing the cap member of the ink jet printer shown in FIG. 11.

As shown in FIGS. 11 and 12, in this embodiment, the space, which is equivalent to the ink receiving space 27 shown in FIG. 9, formed on the upper half part in the cap member 25 is divided into a plurality of individual spaces 41 by partition walls 42. More concretely, the space on the upper half part in the cap member 25 is divided into four individual spaces 41 and the respective individual spaces 41 correspond to four nozzle rows 24 formed on the nozzle forming face 23 of the printing head 9. The partition walls 42 make contact with the nozzle forming face 23 together with the cap member 25 and the respective individual spaces 41 form individual closed spaces. The partition walls 42 are preferably formed integrally by the same material as that of the cap member 25. Further, from the nozzle openings 22 belonging to the same nozzle row 24, the same kink of ink is ejected and from the nozzle openings 22 belonging to a different nozzle row 24, a different kink of ink is ejected.

Further, this embodiment is structured so that the entire filter member 28 is not used and by blindfolding pieces 47 formed on the top side (the side of the nozzle forming face 23) of the filter member 28, over the entire filter member 28, only narrow areas 28*a* extending along the positions opposite to the respective nozzle rows 24 function effectively. By limiting the effective part of the filter member 28 to the narrow areas 28*a* opposite to the nozzle rows 24 like this, the point of time when all the nozzle openings 22 belonging to one nozzle row 24 are recovered and the point of time when all the effective areas (that is, the narrow areas 28*a*) of the filter member 28 get wet by ink can almost coincide with each other.

According to this embodiment having the aforementioned constitution, each individual space 41 is formed according to each nozzle row 24, and each narrow area 28*a* of the filter member 28 is formed according to each individual space 41, so that the resistance increasing function of the filter member 28 due to ink permeation is performed for each individual space 41. Therefore, when there is a difference in the time required for up to recovery of clogging between the nozzle rows 24, from the narrow area 28*a* of the filter member 28 corresponding to the nozzle row 24 whose clogging is recovered, the fluid flow resistance increases sequentially. By doing this, excessive suction of ink form the recovered nozzle row 24 can be suppressed, and at the same time, negative pressure reduction by the recovered nozzle row is selectively suppressed, and on the nozzle row filled with ink which is more difficult to be recovered, high negative pressure can be applied immediately.

Further, in this embodiment, the common negative pressure chamber 29 is formed on the rear side of the filter member 28, so that almost uniform negative pressure can be applied on the four narrow areas 28*a* of the filter member 28.

Further, it is decided at the time of design how to divide the inside of the cap member 25 by the partition walls 42, in consideration of the structural factors such as the nozzle arrangement of the nozzle forming face 23 of the printing head 9 and the clogging factors such as the ejection ink kind of the nozzle openings 22. For example, in the printing head 9 having a plurality of nozzle opening groups of different filling ink kinds, differences are generated in the clogging state of the nozzle openings 22 of the printing head 9 for each color due to differences in the ink component and composition, thus the negative pressure and ink suction rate necessary for cleaning may be different for each nozzle opening group. In such a case, when the inside of the cap member 25 is divided for each ink kind by the partition walls 42, the ink suction suppression action by the filter member 28 is performed independently for each divided individual space 41, thus excessive suction of ink can be suppressed from the nozzle opening group of an ink kind of easily recoverable clogging. Furthermore, suppression of excessive suction of ink generates an effect of suppressing the negative pressure reduction from the recovered nozzle opening group and to the nozzle opening group filled with ink which is more difficult to recover, high negative pressure can be applied immediately.

Next, the ink jet printer of still another embodiment of the present invention will be explained by referring to FIGS. 13 and 14. Further, the explanation of the parts common to the aforementioned embodiment is omitted and different parts will be explained.

Figure 13:
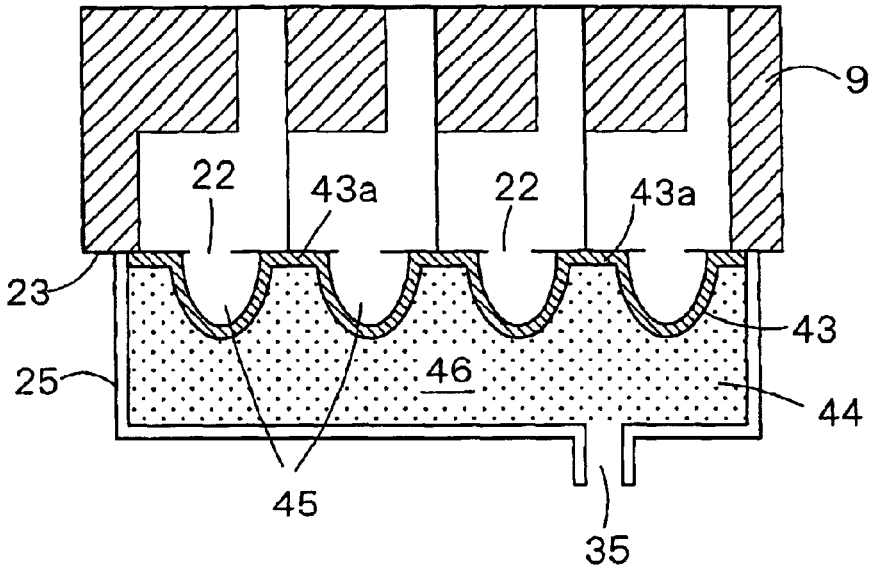
FIG. 13 is a sectional view showing the printing head and cap member in the capping state in an ink jet printer as still another embodiment of the liquid ejecting apparatus of the present invention.
Figure 14:
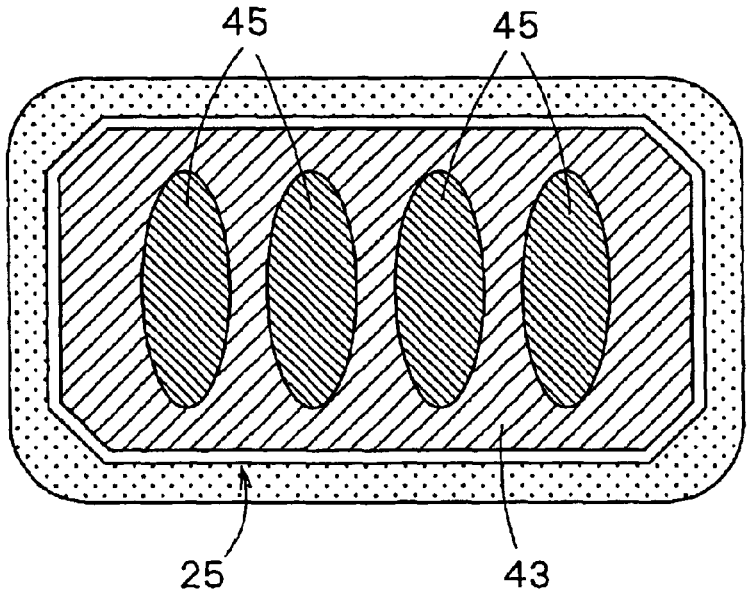
FIG. 14 is a plan view showing the cap member of the ink jet printer shown in FIG. 13.

As shown in FIGS. 13 and 14, in this embodiment, a filter member 43 in which concavities 45 corresponding to the respective nozzle rows 24 are formed is arranged in the cap member 25. Flat parts 43*a* of the filter member 43 other than the concavities 45, at the time of capping, make contact with the nozzle forming face 23 of the printing head 9 together with the cap member 25.

Further, the filter member 43 in this embodiment, in the same way as with the aforementioned embodiment, lets gas such as air pass through, thereby enables quick transfer of negative pressure. However, at the time of passing of a liquid such as ink, a high flow resistance is generated in the filter member 43 and ink suction is suppressed against an increase in the negative pressure due to the continuous operation of the suction pump 19.

In the cap member 25 on the inside of the filter member 43, a common negative pressure chamber 46 for applying almost uniform negative pressure on almost overall the rear of the filter member 43 is formed. The common negative pressure chamber 46 is filled with a filler 44 made of an expanding agent which is integral with the filter member 43. The filler 44 is fluid-permeable and has a low fluid resistance such that uniform pressure is generated in overall the common negative pressure chamber 46 when gas passes through the common negative pressure chamber 46.

In this embodiment, at the time of capping, the flat parts of the filter member 43 are pushed against the nozzle forming face 23 of the printing head 9, thus the spaces corresponding to the concavities 45 of the filter member 43 become individual spaces divided for each ink kind.

According to this embodiment having the aforementioned constitution, during the cleaning operation (the ink suction operation), the individual spaces composed of the concavities 45 are filled with sucked ink, and the filter member 43 on the parts constituting the walls of the individual spaces gets wet with ink, and ink suction of the nozzle row 24 corresponding to the individual spaces is suppressed. By doing this, excessive suction from the recovered or filled nozzle row 24 can be suppressed and negative pressure can be effectively applied on the non-recovered or non-filled nozzle row 24.

Further, according to this embodiment, the walls of the individual spaces are formed by the filter member 43 through which gas such as air can pass easily and gas ejected from the upstream can be easily ejected toward the suction pump 19, so that there is little possibility of remaining of gas such as air in the printing head 19 and more reliable cleaning is enabled.

Next, the ink jet printer of a further embodiment of the present invention will be explained by referring to FIGS. 15 and 16. Further, the explanation of the parts common to the aforementioned embodiment is omitted and different parts will be explained.

Figure 15:
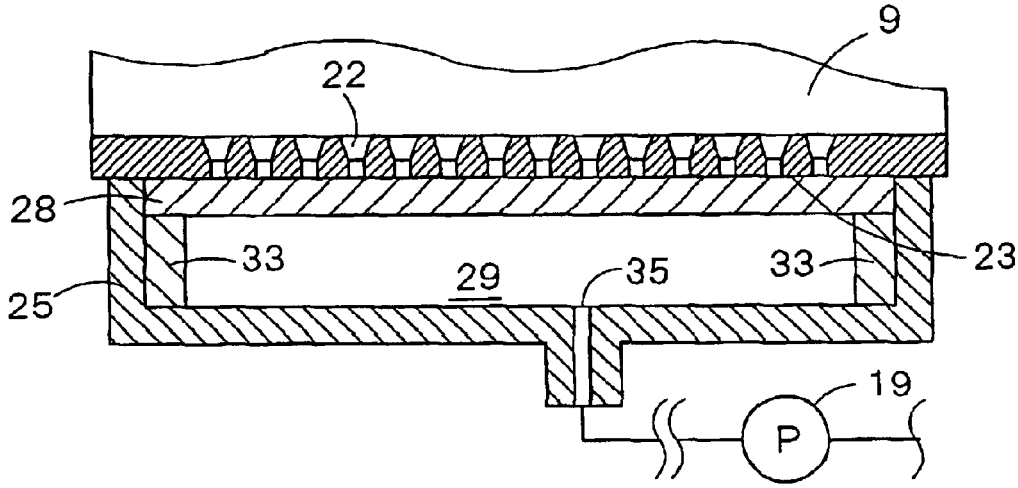
FIG. 15 is a sectional view showing the printing head and cap member in the capping state in an ink jet printer as a further embodiment of the liquid ejecting apparatus of the present invention.

As shown in FIG. 15, this embodiment has a constitution that the ink receiving space 27 in the aforementioned embodiment shown in FIG. 9 is omitted. In this embodiment, the filter member 28 loaded on the top of the step 33 in the cap member 25 is arranged so as to make close contact with the nozzle forming face 23 when the cap member 25 makes contact with the nozzle forming face 23 of the printing head 9.

Figure 16:
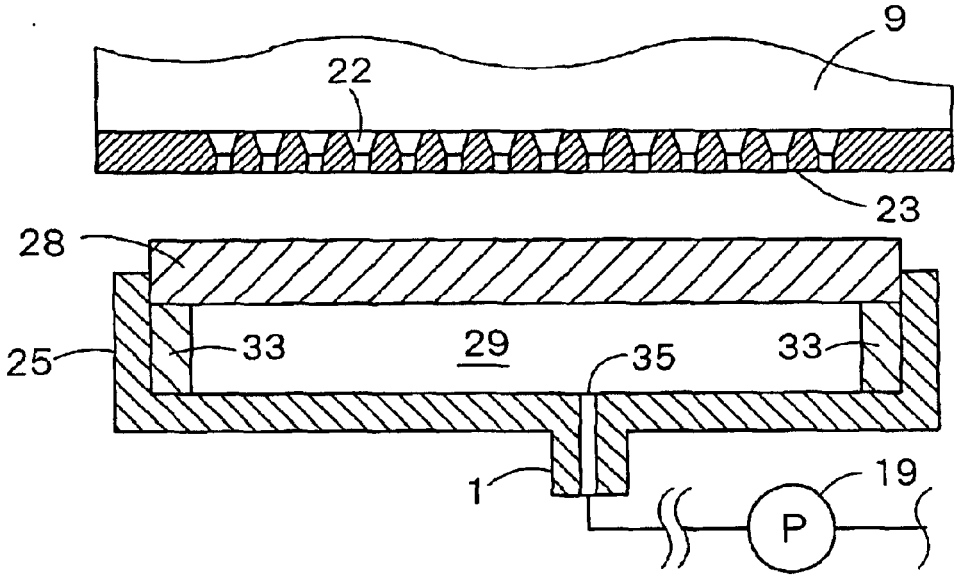
FIG. 16 is a sectional view showing the printing head and cap member in a non-capping state in an ink jet printer as a preferred example of the embodiment shown in FIG. 15.

Further, as a preferable example, as shown in FIG. 16, the filter member 28 may be structured so that a part of the filter member 28 is projected from the opening in the top of the cap member 25 when the filter member 28 is away from the nozzle forming face 23.

In this embodiment, during capping, the filter member 28 is pressed against the entire nozzle forming face 23 of the printing head 9. By doing this, the ink flow suppression effect by the filter member 28 can be produced independently for each nozzle opening 22. Therefore, from the nozzle opening 22 completed filling of ink earlier or the nozzle opening 22 completed recovery of clogging earlier, excessive suction due to additional ink suction can be suppressed. This embodiment is particularly effective in a case that the clogging state is different for each nozzle opening 22.

Next, the ink jet printer of a still further embodiment of the present invention will be explained by referring to FIG. 17. Further, the explanation of the parts common to the aforementioned embodiment is omitted and different parts will be explained.

Figure 17:
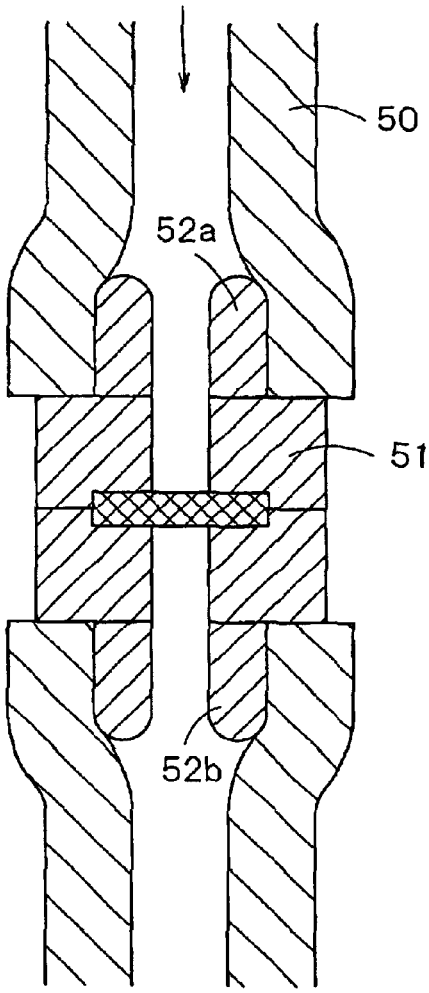
FIG. 17 is a sectional view showing the filter member and its neighborhood, which are enlarged, of an ink jet printer as a still further embodiment of the liquid ejecting apparatus of the present invention.
Figure 18:
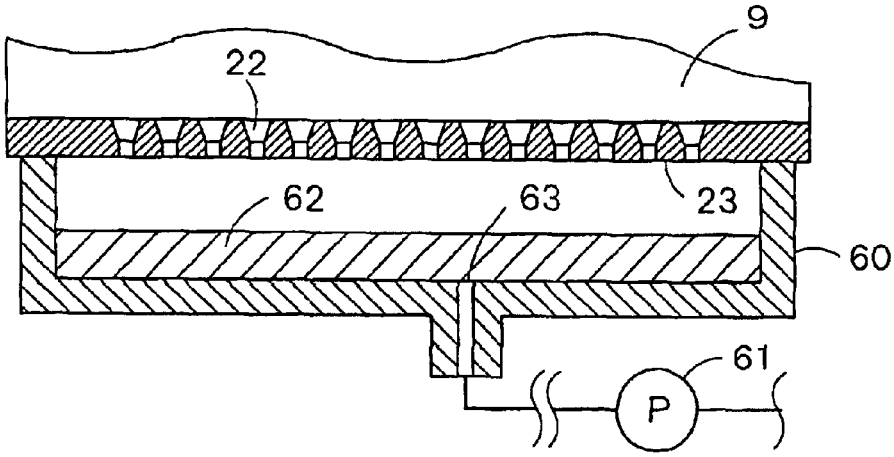
FIG. 18 is a sectional view showing the printing head and cap member in a capping state in a conventional ink jet printer.

As shown in FIG. 17, in this embodiment, in the middle of a suction pipe 50 connecting the cap member 25 and the suction pump 19, a filter member 51 for suppressing the ink flow rate due to the ink flow resistance is installed. More concretely, the middle of the suction pipe 50 is connected by an upstream side coupling 52*a* and a downstream side coupling 52*b* and the filter member 51 is held between the pair of couplings 52*a* and 52*b*.

According to this embodiment, at the point of time when sucked ink reaches the position of the filter member 51, the ink suction force by the suction pump 19 is suppressed. Therefore, when the distance from the cap member 25 to the filter member 51 is optimized, at the point of time when the ink suction rate after start of the suction operation reaches a desired value, the ink suction force is automatically suppressed and the excessive suction can be suppressed.

As a modified example of this embodiment, in place of the filter member 51, a constitution that a fan means for rotating by the flow of a fluid passing through, thereby generating a flow resistance is installed may be considered. Further, in place of installation of the filter member 51, a constitution that a part of the suction path is excessively narrowed or a part of the inner wall of the suction path is provided with a large frictional resistance with ink may be considered.

The specific embodiments of the present invention are explained above as examples. It is obvious to those skilled in the art in the field of the present invention that the present invention can be variously modified and changed without departing from the spirit and scope of the present invention. Such changes included within the scope of the present invention are all included within the scope of the claims.

What is claimed is:

1. A liquid suction apparatus for sucking a liquid from a plurality of nozzle openings of a liquid ejecting head for ejecting liquid drops toward an object from said plurality of nozzle openings, comprising:

a cap member configured to internally form a closed space when said cap member makes contact with a nozzle forming face of said liquid ejecting head;

a negative pressure generating unit configured to eject a fluid in said closed space formed in said cap member and generate negative pressure in said closed space; and a filter member arranged so that at least a part thereof is positioned in said cap member, wherein a common negative pressure chamber is formed on a downstream side of said filter member in a liquid flow direction during suction, said common negative pressure chamber being configured to apply an almost uniform negative pressure on almost overall said filter member, said negative pressure generating unit being connected to said cap member so as to eject a fluid in said common negative pressure chamber.

2. A liquid suction apparatus according to claim 1, wherein said filter member is structured so that when said cap member makes contact with said nozzle forming face, a liquid receiving space is formed between said nozzle forming face and said filter member.

3. A liquid suction apparatus according to claim 2, wherein said liquid receiving space is a single space corresponding to all of said plurality of nozzle openings.

4. A liquid suction apparatus according to claim 2, wherein said liquid receiving space is divided into a plurality of individual spaces.

5. A liquid suction apparatus according to claim 4, wherein said plurality of nozzle openings constitute several nozzle rows, said plurality of individual spaces being formed in correspondence with respective several nozzle rows.

6. A liquid suction apparatus according to claim 5, wherein said filter member is structured so as to effectively function only in narrow areas extending along positions opposite to said respective several nozzle rows.

7. A liquid suction apparatus according to claim 4, wherein said plurality of individual spaces are formed for each nozzle opening group composed of a plurality of nozzle openings of a common liquid kind to be ejected.

8. A liquid suction apparatus according to claim 4, wherein said plurality of individual spaces are formed by partition members provided separately from said filter member.

9. A liquid suction apparatus according to claim 4, wherein said plurality of individual spaces are formed by said filter member itself.

10. A liquid suction apparatus according to claim 1, wherein said filter member is structured so as to make close contact with at least a part of said nozzle forming face when said cap member makes contact with said nozzle forming face.

11. A liquid suction apparatus according to claim 10, wherein said filter member is structured so as to make close contact with almost overall said nozzle forming face when said cap member makes contact with said nozzle forming face.

12. A liquid suction apparatus according to claim 10, wherein said filter member is structured so that a part thereof is projected from said cap member toward said nozzle forming face.

13. A liquid suction apparatus according to claim 1, wherein said common negative pressure chamber is filled with a fluid permeable filler material, said fluid permeable filler material having a fluid resistance such that substantially uniform pressure is generated in overall said common negative pressure chamber when a gas passes through said common negative pressure chamber.

14. A liquid suction apparatus according to claim 13, wherein said filler material is an expanding agent.

15. A liquid ejecting apparatus comprising:

a liquid ejecting head configured to change pressure of a liquid in pressure chambers respectively interconnecting to a plurality of nozzle openings and eject liquid drops toward an object from said nozzle openings; and a liquid suction apparatus as defined in claim 1.

* * * * *